United States Patent [19]

Kerr

[11] 4,099,396

[45] Jul. 11, 1978

[54] PICK-RESISTANT AXIAL SPLIT-PIN TUMBLER-TYPE LOCK MECHANISM

[75] Inventor: William J. Kerr, Madison, Wis.

[73] Assignee: Chicago Lock Co., Chicago, Ill.

[21] Appl. No.: 824,442

[22] Filed: Aug. 15, 1977

[51] Int. Cl.[2] ..... E05B 27/08

[52] U.S. Cl. ..... 70/363; 70/419

[58] Field of Search ..... 70/363, 419, 378, 376, 70/416, 421

[56] References Cited

U.S. PATENT DOCUMENTS

| | | | |
|---|---|---|---|
| 651,130 | 6/1900 | Carter | 70/363 |
| 1,619,252 | 3/1927 | George | 70/363 |
| 1,998,900 | 4/1935 | Lombardo | 70/363 |
| 2,629,249 | 2/1953 | Mendelsohn | 70/419 |

*Primary Examiner*—Robert L. Wolfe
*Attorney, Agent, or Firm*—Norman H. Gerlach

[57] ABSTRACT

An axial split-pin tumbler-type lock mechanism includes a rotatable operating part and a stationary part, which adjoin at an interfacial plane. Tumblers each including a driver element and a follower element are mounted in bores in the parts. The bores meet in alignment at the interfacial plane, and the tumblers are movable back and forth in the aligned bores. When the joints between the tumbler elements coincide with the interfacial plane upon insertion of a key, the operating part may be rotated by means of the key, to accomplish a desired function. The lock mechanism is provided with structure making is resistant to picking, including adjacent pairs of aligned bores in longitudinal communication with each other to permit sidewise engagement of an element of a tumbler in one pair with an element of a tumbler in the remaining pair, and mechanical interlock means on a side surface of an element of a tumbler disposed in each of the adjacent pairs of aligned bores, the interlock means on respective elements being adapted for engagement with each other to interengage the elements, whereby when one of the latter tumbler elements bridges the interfacial plane, application of picking torque to the operating part tends to move the elements laterally relative to each other to cause such interengagement thereof and thereby constrain the elements to move together as a unit in the axial direction.

16 Claims, 13 Drawing Figures

PICK-RESISTANT AXIAL SPLIT-PIN TUMBLER-TYPE LOCK MECHANISM

BACKGROUND OF THE INVENTION

This invention relates to axial split-pin tumbler-type lock mechanisms having structure designed to render them resistant to picking.

In general, the axial split-pin tumbler-type lock mechanisms include a rotatable operating part and a stationary part, which adjoin at an interfacial plane. Tumblers each including a driver element and a follower element are mounted in bores in the parts which meet in alignment at the interfacial plane, and the tumblers are movable back and forth in the bores. When the joints between the tumbler elements coincide with the interfacial plane upon insertion of the proper key, the operating part may be rotated by means of the key, to accomplish a desired function. Illustrative of the lock mechanisms to which the present invention is directed are Kerr U.S. Pat. No. 3,541,819, Kerr U.S. Pat. No. 3,813,906, and Steinbach U.S. Pat. No. 3,916,657.

As disclosed in U.S. Pat. No. 3,541,819, the lock mechanisms of the foregoing type have in the past been picked, embodying what may be referred to as a "gang pick," of the type disclosed in the patent. In use, the pick is applied to the lock mechanism, a rotational torque or bias is applied to the operating part thereby, to displace the operating part to a slight extent relative to the stationary part, and a jiggling motion is utilized to work the tumbler elements from rear to front and catch them at the interfacial plane, on the margins of tumbler bores which project over adjacent bores. When an element of each of the tumblers has been caught at the interfacial plane in such manner, the operating part is free to rotate and the lock mechanism is in an unlocked condition. In another type of picking tool, the tumblers are picked individually, and the tumbler elements are worked from front to rear. Numerous improvements have been devised to increase the pick resistance of lock mechanisms such as those illustrated by the foregoing patents, and they have met with varying degrees of success.

SUMMARY OF THE INVENTION

The present invention provides an axial split-pin tumbler-type lock mechanism having new and improved structure serving to render the mechanism pick-resistant, the structure being adapted to resist picking with either or both of the above-described types of picking tools.

In its broader aspects, the invention provides an improvement in an axial split-pin tumbler-type lock mechanism which includes a lock cylinder, a barrel assembly secured within the cylinder and having a longitudinal axis extending between front and rear ends thereof, such barrel assembly including a forwardly disposed operating part rotatable about the axis and a rearwardly disposed stationary part adjoining the operating part at a transverse interfacial plane, means forming longitudinal bores in the operating and stationary parts, respectively, the bores in respective parts being movable into and out of alignment upon rotation of the operating part, tumblers each having a forwardly disposed driver element carried in one of the operating part bores and a separate rearwardly disposed follower element carried in one of the stationary part bores and the elements adjoining each other when in a pair of aligned bores, the tumblers each being reciprocally movable in the axial direction in a pair of aligned bores between positions wherein the joint between the elements thereof is disposed respectively on opposite sides of the interfacial plane, the operating part being freed for rotation when the joints coincide with the interfacial plane, and spring means yieldingly urging the tumblers in aligned bores forwardly to positions wherein the interfacial plane is bridged by the follower elements to secure the operating and stationary parts against relative rotation, the driver elements having front ends engageable with a key which when moved rearwardly moves the tumblers in aligned bores into positions wherein the joints coincide with the interfacial plane, such improvement comprising: providing at least one combination of two adjacent ones of said pairs of aligned bores in longitudinal communication with each other to permit sidewise engagement of an element of a tumbler in one pair with an element of a tumbler in the remaining pair, and mechanical interlock means on a side surface of an element of a tumbler disposed in each of the adjacent pairs of aligned bores, the interlock means on respective elements being adapted for engagement with each other to interengage the elements, whereby when one of the latter tumbler elements bridges the interfacial plane, application of picking torque to the operating part tends to move the elements laterally relative to each other to cause such interengagement thereof and thereby constrain the elements to move together as a unit in the axial direction.

When a lock mechanism is provided with the improved structure, the application of rotational torque by a picking tool when the joints of adjacent tumblers are in staggered relation to each other, and the resulting interengagement of adjacent tumbler elements, precludes movement of both of the tumbler joints into coincidence with the interfacial plane at the same time, as is necessary to reach an unlocked condition. Thus, the application of torque, which is required for picking the tumblers with picking tools and using methods such as described above, acts to prevent the picking of one or more of the tumblers constructed according to the invention, thereby defeating the attempt to pick the lock mechanism.

BRIEF DESCRIPTION OF THE DRAWINGS

The attached drawings illustrate a preferred embodiment of the lock mechanism of the invention, without limitation thereto. In the drawings, like elements are identified by like reference numerals in each of the views, and.

DESCRIPTION OF THE PREFERRED EMBODIMENT

Figure 2:
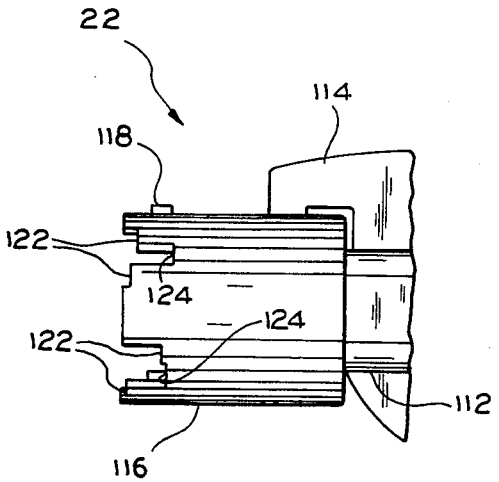
FIG. 2 is an enlarged fragmentary side elevational view of the key.

Referring to the drawings, particularly to FIGS. 1-5, an axial split-pin tumbler-type lock mechanism or lock 20 is employed with a tubular key 22. The particular illustrative lock mechanism 20 is designed for use as part of a switch lock, such as illustrated in U.S. Pat. No. 3,813,906, in which the lock mechanism 20 is encased in an outer cylindrical tubular part, not shown. Alternatively, the lock mechanism may be modified for other uses, such as with a locking plate or cam structure, in a manner such as illustrated in U.S. Pat. No. 3,541,819.

The lock mechanism includes, as its principal parts, a lock cylinder 24, a rotatable operating part 26, and a stationary tubular sleeve part 28, the operating part and the sleeve part together constituting a barrel assembly. The operating part 26 is constructed of a spindle unit 30 and a post unit 32, illustrated also in FIGS. 6-9. The lock mechanism 20 also includes a plurality of pick-resistant tumblers 34, which are eight in number in the illustrative embodiment, and a coil compression spring 36 for each tumbler. Each of the tumblers 34 includes a driver element or pin 38 illustrated also in FIG. 12, all of which are similar, except for varying lengths. Each of the tumblers 34 also includes a follower or locking element or pin 40, illustrated also in FIG. 13, having a body 41 and a reduced diameter stem 42. All of the follower elements are similar, except for varying lengths.

The lock cylinder 24 includes a cylindrical tubular body 43 having a cylindrical bore 44 and an annular closure flange 46 extending radially inwardly from the body and defining a circular key opening 47 at the front end 48 of the cylinder. A key guide notch 50 extends radially outwardly from the inner edge of the closure flange 46. A pair of diametrically opposed mounting holes 52 is provided in the body 43 adjacent to and spaced from the rear end 54 of the cylinder.

Referring to FIGS. 4-8, the spindle unit 30 is an integral unit of a generally cylindrical shaft 56, a generally cylindrical head 58 of greater diameter, and a generally frusto-conical shank 60. The spindle unit 30 has a longitudinal axis 61, and transverse front and rear faces 58*a* and 58*b* on the head 58 lie in planes perpendicular to the axis. The spindle unit 30 is provided with a substantially cylindrical blind bore 62 extending axially inwardly from the front end of the shank 60. A tang-receiving slot 64 extends diametrically across the rear end of the shaft 56. An annular split ring-receiving groove 66 is provided on the shaft 56 adjacent to and spaced from its rear end.

Cylindrically-shaped longitudinal tumbler bores 70 are formed in the spindle unit head 56, extend between the front and rear faces 58*a* and 58*b* thereof, and extend forwardly from the head through the shank 60. The bores are in the form of recesses in the outer surface of the head 58 and shank 60, and they are disposed radially outwardly of the shaft 56. In the illustrative embodiment, eight such tumbler bores are provided in the spindle unit 30 of the operating part 26, and they are arranged in pairs of adjacent bores separated by lands 72 on the head 58. The pairs of bores 70 and the lands 72, respectively, are equiangularly disposed around the axis 61. The bores 70 in each pair are separated by a longitudinal ridge 74, which, together with the lands 72 on opposite sides of the bores, forms shallow pockets defining the bores. The shank 60 also is provided with a longitudinal drive groove 76 (FIG. 6) therein, in alignment with one of the lands 72.

Figure 9:
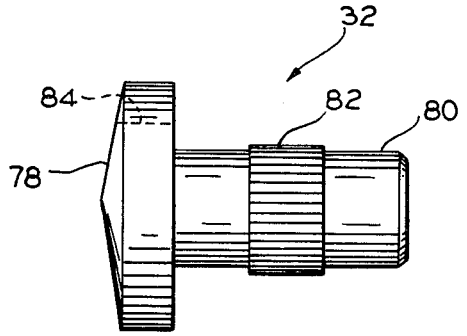
FIG. 9 is a side elevational view of a post unit of the operating part, on the same scale.

Referring to FIG. 9, the post unit 32 includes a generally cylindrical key guide disc 78, and an integral coaxial generally cylindrical shank 80 of reduced diameter, having a slightly enlarged knurl ring 82 therearound. A longitudinal drive groove 84 extends inwardly from the periphery of the disc 78. The post unit 52 is assembled with the spindle unit 30 to provide the operating part 26, by inserting the shank 80 of the post unit in the bore 62 of the spindle unit, with the knurl ring 82 providing a drive fit therein. The disc 78 seats on the spindle unit shank 60, and the drive groove 84 in the post unit is aligned with the drive groove 76 in the spindle unit.

In the illustrative embodiment, the post unit 32 may be constructed of a very hard metal, to thwart attempts to drill through the lock in this area. Alternatively, the operating part 26 may be constructed in other ways, with the post unit 32 and the spindle unit 30 integral with each other, or with other components formed separately, as most desirable for manufacture and intended use.

Figure 10:
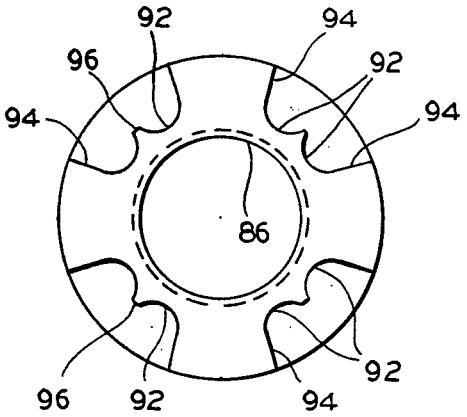
FIGS. 10 and 11, are, respectively, front end elevational and side elevational views of a sleeve part in the lock mechanism, on the same scale.
Figure 11:
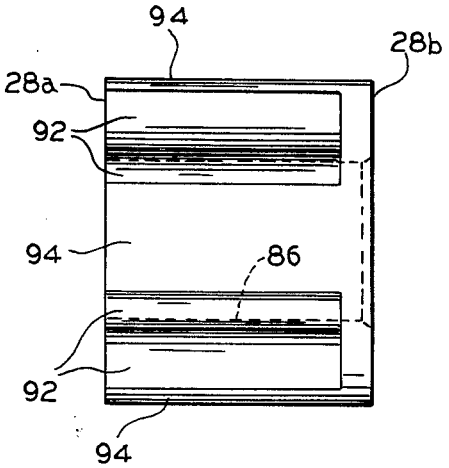

Referring to FIGS. 10 and 11, the sleeve part 28 is of generally cylindrical configuration, having an outside diameter the same as the diameter of the spindle part head 58, and both diameters being slightly smaller than the diameter of the cylinder bore 44. The sleeve part 28 has a substantially cylindrical inner surface wall 86, which has a diameter slightly greater than the outer diameter of the spindle unit shaft 56, for journaling the shaft in the sleeve part. The sleeve part 28 has transverse front and rear faces 28*a* and 28*b* which lie in planes perpendicular to the longitudinal axis 88 of the part. Two diametrically opposed radial mounting bores 90 are provided in the sleeve part intermediate its front and rear faces.

Cylindrically-shaped longitudinal tumbler bores 92 are formed in the sleeve part 28 and extend rearwardly from its front face 28*a* to points adjacent to and spaced from its rear face 28*b*. The sleeve part tumbler bores 92, similarly to the operating part tumbler bores 70, are in the form of recesses in the outer surface of the sleeve part 28, and are eight in number and arranged in pairs of adjacent bores separated by lands 94. The bores 92 in each pair are separated by a longitudinal ridge 96, which, together with the lands 94 on opposite sides thereof, forms shallow pockets defining the bores. The sleeve part tumbler bores 92 have the same diameter and angular spacing as the operating part tumbler bores 70. The tumbler bores 70 and 92 are disposed at the same radial distance from the respective axes 61 and 88.

Figure 12:
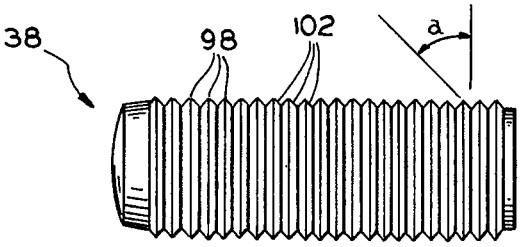
FIGS. 12 and 13 are further enlarged side elevational views of, respectively, a tumbler driver element and a tumbler follower element in the lock mechanism.
Figure 13:
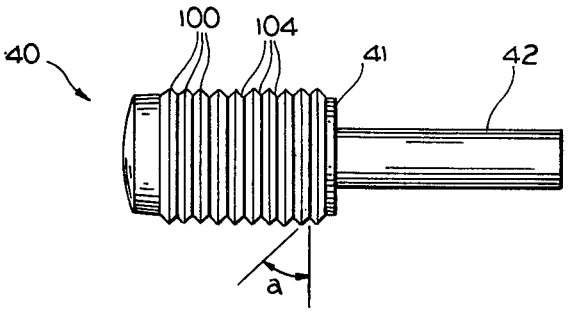

Referring to FIGS. 12 and 13, the driver element 38 and the body 41 of the follower element 40 have generally circular cross sections of like diameter, and they are in the form of cylindrical bodies rolled to provide a longitudinal series of circumferential ring-like projections 98 and 100 of like depth and pitch on the respective elements. The projections 98 and 100 are angular in cross section and alternate with angular grooves 102 and 104, respectively, similarly to a threaded structure.

The sides or faces of the projections 98 and 100 on the respective elements 38 and 40 preferably extend outwardly at angles *a* of about 45° to planes perpendicular to the longitudinal axes of the elements. The sides of each projection 98 and 100 then intersect each other and the sides of adjacent projections at angles of about 90°. The outer diameters of the elements 38 and 40 are slightly smaller than the diameters of the tumbler bores 70 and 92. The projections 98 and 100 provide mechanical interlock means around the circumference of each element. The projections 98 or 100 on each element are adapted for engagement with such projections on another element adjacent thereto, with the projections on one element received in the grooves 102 or 104 in the adjacent element.

Figure 4:
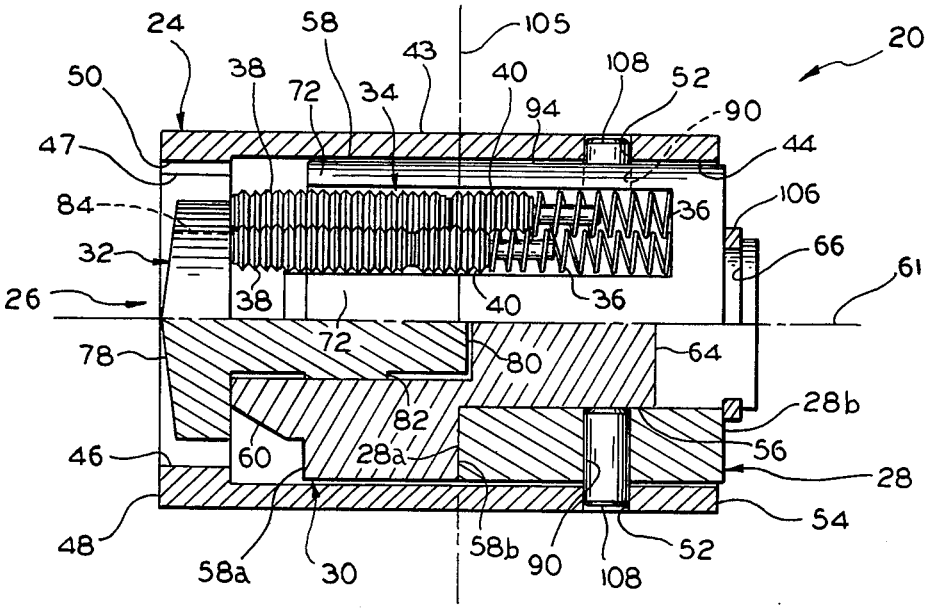
FIG. 4 is an enlarged longitudinal sectional and elevational view of the lock mechanism, taken substantially on lines 4—4 of FIG. 3.
Figure 5:
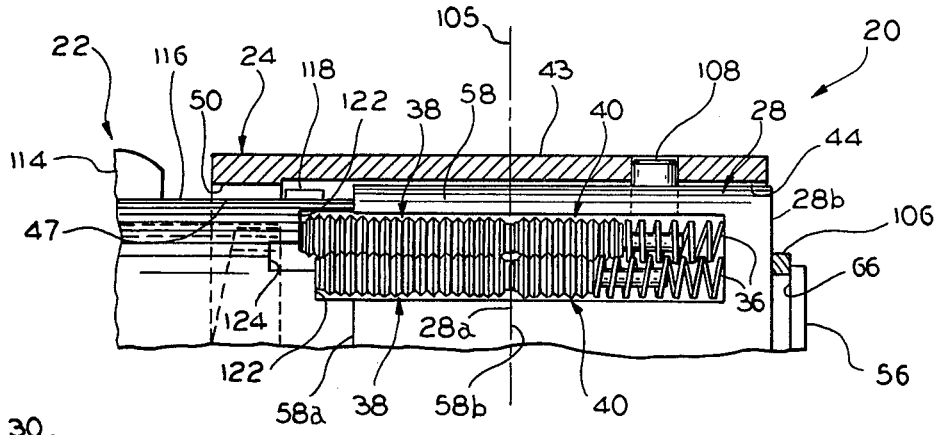
FIG. 5 is a view similar to FIG. 4 of the upper portion of the lock mechanism, illustrating also a portion of the key inserted in the lock mechanism, to place it in an unlocked condition.
Figure 6:
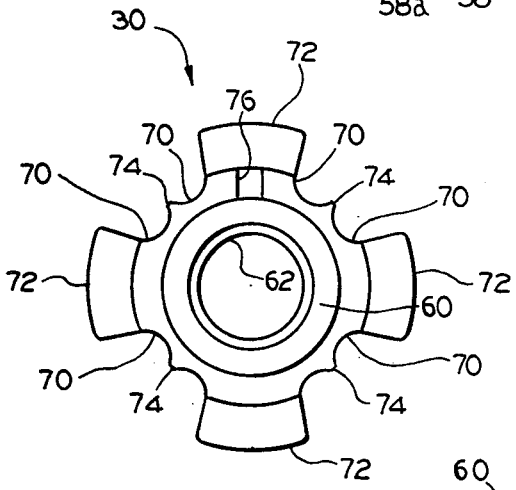
FIGS. 6–8 are, respectively, front end elevational, side elevational, and rear end elevational views of a spindle unit of an operating part in the lock mechanism, illustrated on the same scale as FIG. 4.
Figure 7:
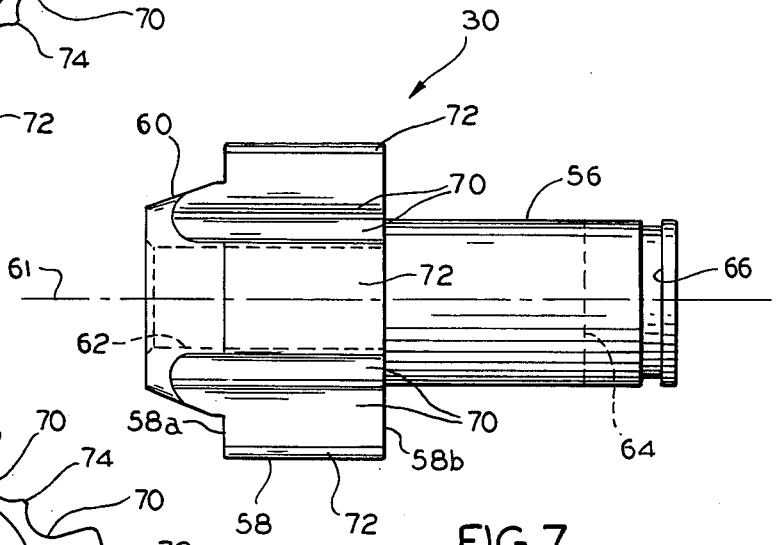
Figure 8:
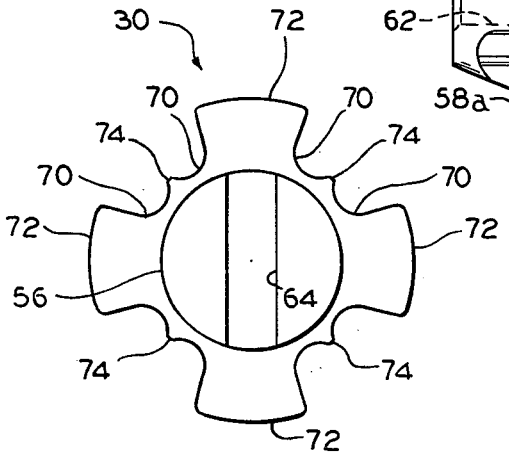

Referring to FIGS. 4 and 5, the operating part shaft 56 is inserted through the sleeve part 28 in assembling the lock mechanism 20. The rear face 58*b* of the operating part head 58 adjoins the front face 28*a* of the sleeve part 28 at a transverse interfacial plane 105. The operating part 26 and the sleeve part 28 are secured together for relative rotation therebetween, by means of a split ring 106 received in the groove 66 adjacent to the rear end of the shaft 56, which projects beyond the sleeve part 28. A tumbler spring 36 is seated in each of the tumbler bores 92 in the sleeve part 28. A follower element 40 is seated on each of the tumbler springs 36, with the stem 42 of the element received within the spring. A driver element 38 is seated on each of the follower elements 40.

The resulting subassembly is inserted into the cylinder bore 44 from the rear end 54 of the cylinder 24, with the key guide disc 78 extending into the key opening 47 and approximately to the front end 48 of the cylinder. The subassembly is secured within the cylinder 24 by mounting pins 108, which are inserted through the mounting holes 52 in the cylinder and into the registering mounting bores 90 in the sleeve part 28, with a drive fit in the bores.

Figure 3:
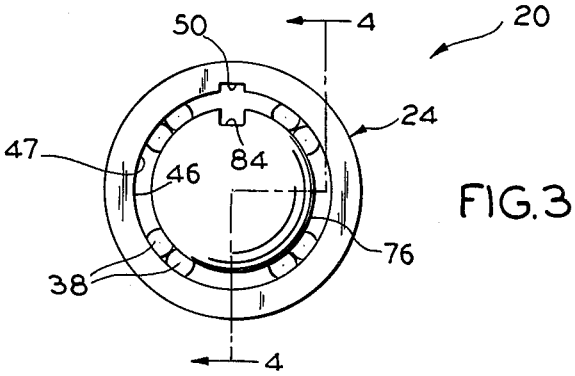
FIG. 3 is a front end elevational view of the lock mechanism.

In general, the follower elements 40 are carried in the sleeve part bores 92, and the driver elements 38 are carried in the operating part bores 70, in the assembled lock mechanism 20. However, when the lock mechanism 20 is in its locked condition, the follower elements 40 extend into the operating part head 58 under the pressure of the tumbler springs 36, to bridge the interfacial plane 105, as illustrated in FIG. 4. At this time, the front ends of the driver elements 38 abut on the inner surface of the closure flange 46 and also on the inner surface of the key guide disc 78. The centers of the driver elements 38 are accessible through the key opening 47, as illustrated in FIG. 3. The tumblers 34 are reciprocally movable in the axial direction in pairs of aligned tumbler bores 70 and 92, between positions wherein the joints between the tumbler elements 38 and 40 are disposed respectively on opposite sides of the interfacial plane 105, such joints comprising the interfaces between the front ends of the follower elements 40 and the rear ends of the driver elements 38.

In the assembled lock mechanism 20, the longitudinal axis 61 of the spindle unit 30, and also of the operating part 26, is coincident with the longitudinal axis 88 of the sleeve part 28, and with the longitudinal axis of the lock cylinder 24, as represented by the axis 61 in FIG. 4. The sleeve part 28 is stationary in the lock mechanism, and the operating part 26 is rotatable therein when the joints between the tumbler elements 38 and 40 coincide with the interfacial plane 105. Rotation of the operating part 26 serves to perform a desired function, by means of a connection made to the shaft 56. The illustrative structure is designed for receiving the tang of a switch mechanism, not illustrated, in the slot 64 at the rear end of the shaft 56. Alternatively, other connections to the shaft 56 may be made, in conventional ways.

Figure 1:
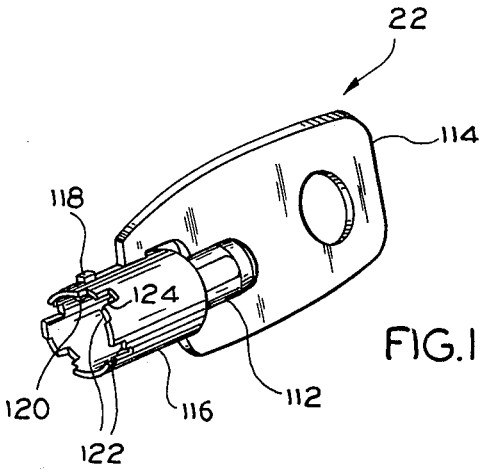
FIG. 1 is a perspective view of a key which cooperates with the lock mechanism of FIGS. 3–5.

Referring to FIG. 1, the key 22 is a generally conventional structure, which includes a body 112 connected to a wing-type torque-applying or manipulating handle 114. The body includes a cylindrical tubular shank 116 having an inside diameter slightly greater than the diameter of the key guide disc 78. Adjacent to the outer end of the shank 116, a longitudinally extending guide lug 118 extends radially outwardly from the shank, and a longitudinally extending drive lug 120 extends radially inwardly from the shank. The outer end of the shank 116 is notched or slotted to provide a circumferential series of eight bittings or shoulders 122 of various depths. The bittings 122 are arranged in four pairs of adjacent bittings, corresponding to the tumbler bores 70 and 92 in the barrel assembly. A separation is provided between the bittings in each pair, by a notch 124 cut into the shank 116 and extending inwardly beyond the bittings.

Referring to FIGS. 3–5, the key guide notch 50 and the drive groove 84 are radially aligned when the lock mechanism 20 is in its initial, locked condition. The key 22 is inserted into the lock mechanism 20 for unlocking purposes by inserting the shank 116 in the key opening 47 and around the guide disc 78. The guide lug 118 on the key is inserted in the guide notch 50 in the closure flange 46, and the drive lug 120 is inserted in the drive groove 84 in the guide head 78 and also in the registering drive groove 76 in the shank 60 of the spindle unit 30.

The bittings 122 abuttingly engage the central portions of the driver elements 38 as the key 22 is inserted in the lock mechanism 20. Movement of the key towards the rear of the lock mechanism move the tumblers 34 in aligned tumbler bores 70 and 92 rearwardly, until the shank 116 of the key bottoms on the front face 58*a* of the spindle unit head 58, as illustrated in FIG. 5. The tumblers in adjacent pairs of aligned bores 70 and 92 travel in their bores and pass each other without interference, owing to the configuration of the bores and the separation provided by the ridges 74 and 96 between adjacent pairs of aligned bores. With the key fully inserted, the joints between the driver elements 38 and the follower elements 40 coincide with the interfacial plane 105, and the guide lug 118 on the key is disposed rearwardly of the closure flange 46, so that the key may be turned to rotate the operating part 26 and thereby operate the lock.

As noted above, the common picking tools depend for their success upon the application of a rotational torque or bias applied to a rotatable part such as the operating part 26, to rotate it slightly relative to a stationary part such as the sleeve part 28, while tumblers are manipulated to move them into positions wherein their joints coincide with an interfacial plane such as the plane 105. The foregoing structure of the lock mechanism 20 functions to prevent this technique from being successful. Thus, each of the adjacent pairs of aligned bores 70 and 92 is in longitudinal communication with each other, whereby the tumbler elements 38 and 40 in each pair of aligned bores may be moved or shifted laterally relative to the tumbler elements in the other pair, generally circumferentially of the operating and sleeve parts 26 and 28, into sidewise engagement of the elements in one pair of bores with the elements in the remaining pair of bores. The projections 98 and 100 on the tumbler elements 38 and 40, together with the grooves 102 and 104 on the elements, provide mechanical interlock means on the elements. The projections 98 or 100 on one tumbler element 38 or 40 are adapted to enter the grooves 102 or 104 and interfit with the projections 98 or 100 on an adjacent tumbler element, so that the elements are interlocked and constrained to move together as a unit in the axial direction.

The foregoing interengagement of tumbler elements takes place when picking torque is applied to the operating part 26, and one of the tumbler elements bridges the interfacial plane 105 with the lock mechanism 20 in locked condition, as illustrated in FIG. 4. Application of picking torque to the operating part 26 in this condition of the lock mechanism will move one follower element 40 against the adjacent follower element 40, as the former is turned by engagement with a land 72 on the spindle unit 30 while the latter is held by a land 94 on the sleeve part 28 to resist turning. This movement of the follower elements 40 laterally relatively to each other causes their projections 100 to interlock, so that both elements must move rearwardly as a unit when the tumblers 34 are probed. Inasmuch as the joints between the elements of the adjacent tumblers 34 are longitudinally staggered with respect to each other, both joints cannot be made to coincide with the interfacial plane 105 at the same time, as the tumblers 34 are moved rearwardly, so that at least one element of the adjacent tumblers bridges the plane 105 at all times, and the lock cannot be opened.

The tumblers 34 act similarly when the tumbler joints are disposed to the rear of the interfacial plane 105 at the time picking torque is applied. In such case, one of the driver elements 38 is held against turning by the sleeve part 28, while the operating part 26 turns the adjacent driver element 38 and thereby moves it into sidewise interengagement of the projections 98 of the driver elements. The driver elements 38 are interlocked and move together as a unit as the tumblers 34 are moved forwardly. With the joints of the adjacent tumblers 34 in staggered relation, both joints cannot be brought to the interfacial plane 105 at the same time, as is necessary in order to place the lock mechanism 20 in its unlocked condition.

Both the driver elements 38 and the follower elements 40 interlock in the foregoing ways when the tumbler joints are on opposite sides of the interfacial plane 105, with one driver element 38 and one follower element 40 bridging the plane. Moreover, a driver element 38 of one tumbler 34 will engage a follower element 40 of an adjacent tumbler 35 at times, depending upon the amount of overlapping of the elements in adjacent tumblers. Such engagement serves to lock the adjacent tumblers together for movement as a unit and thereby prevent individual movement of the tumblers to bring their joints to the interfacial plane 105 at the same time.

It is preferred to provide mechanical interlock means such as the illustrative structure on both the driver elements 38 and the follower elements 40 of adjacent tumblers 34, to provide maximum sensitivity and resistance to picking, in various circumstances. If desired, however, interlock means may be provided on but one element of each of the adjacent tumblers 34, to increase the pick resistance of the lock mechanism. Thus, interlock means may be provided on the driver elements 38 or on the follower elements 40 of the adjacent tumblers 34, or on a driver element 38 of one of the tumblers and on a follower element 40 of the remaining tumbler.

It will be apparent that resistance to picking will be increased in accordance with the invention by providing at least one combination of two adjacent ones of the pairs of aligned bores 70 and 92 in longitudinal communication with each other to permit sidewise interengagement of tumbler elements situated in the adjacent pairs of bores and having mechanical interlock means. The security of the lock is increased with an increasing number of such combinations, and in the preferred illustrative embodiment, four such combinations are employed.

While adjacent tumblers thus are employed in sets of two in the illustrative embodiment, a greater number may be employed in each set, with corresponding modifications in the structure for mounting the tumblers. As an example, the lock mechanism in another embodiment, not illustrated, has been provided with two sets of five adjacent tumblers, each tumbler being adapted to interlock with the tumbler or tumblers on one or both sides thereof. Advantages of this structure include a greater probability that at least two tumblers will be interlocked and an increase in the number of tumblers that may be locked together at one time, when picking is attempted. The structure has greater play than the preferred embodiment, however.

The projections 98 and 100 are readily and economically provided on the tumbler elements, and they perform their intended function effectively. The preferred side angles *a* of approximately 45° assist in restoring the tumblers to their normal positions following an unsuccessful picking attempt. Thus, adjacent projections 98 and/or 100 become interlocked when picking torque is applied, and when the torque is removed, the force of the tumbler springs 36 moves the projections out of interlocking engagement by cam action of adjacent sides of adjacent projections.

While the illustrative projections 98 and 100 are preferred, other mechanical interlock means may be substituted therefor. Also, while the tumbler bores 70 and 92 are formed externally on the operating and sleeve parts 26 and 28, the bores may be formed internally thereof, similarly to the manner in which the bores are provided in the above-identified patents. However, manufacture of the preferred illustrative structure is simpler and more economical.

Although the invention has been illustrated with reference to a two-part barrel assembly of the operating part 26 and the sleeve part 28, it will be apparent that the invention is similarly applicable to barrel assemblies having more than two parts provided with tumbler bores arranged for alignment. Thus, for example, the invention may be applied to lock mechanisms having three-part barrel assemblies, of types such as disclosed in the above-identified U.S. Pat. Nos. 3,541,819 and 3,916,657.

The structure of the key 22 is preferred, as providing axial application of force to the outer ends of the driver elements 38, tending to maintain them in proper alignment in the bores 70 and 92. The notches 124 provide clearance between the bittings 122, to prevent a driver element 38 from catching on the bitting 122 intended for engagement with the driver element adjacent thereto.

While a preferred embodiment of the invention has been illustrated and described, and reference has been made to certain changes and modifications which may be made in the embodiment, it will be apparent to those skilled in the art that further changes and modifications may be made therein within the spirit and scope of the invention. It is intended that all such changes and modifications be included within the scope of the appended claims.

Having thus described the invention what I claim as new and desire to secure by letters patent is:

1. In an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary part adjoining the operating part at a transverse interfacial plane, means forming longitudinal bores in said operating and stationary parts respectively, said bores in respective parts being movable into and out of alignment upon rotation of said operating part, tumblers each having a forwardly disposed driver element carried in one of said operating part bores and a separate rearwardly disposed follower element carried in one of said stationary part bores and the elements adjoining each other when in a pair of aligned bores, said tumblers each being reciprocally movable in the axial direction in a pair of aligned bores between positions wherein the joint between said elements thereof is disposed respectively on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and stationary parts against relative rotation, said driver elements having front ends engageable with a key which when moved rearwardly moves said tumblers in aligned bores into positions wherein said joints coincide with said interfacial plane, the improvement which comprises:

providing at least one combination of two adjacent ones of said pairs of aligned bores in longitudinal communication with each other to permit sidewise engagement of an element of a tumbler in one pair with an element of a tumbler in the remaining pair, providing mechanical interlock means on a side surface of an element of a tumbler disposed in each of said adjacent pairs of aligned bores, said interlock means on respective elements being adapted for engagement with each other to interengage the elements, whereby when one of said latter tumbler elements bridges said interfacial plane, application of picking torque to said operating part tends to move the elements laterally relative to each other to cause said interengagement thereof and thereby constrain the elements to move together as a unit in the axial direction.

2. A lock mechanism as defined in claim 1 and wherein said mechanical interlock means are provided on the follower elements of the tumblers in said adjacent pairs of aligned bores.

3. A lock mechanism as defined in claim 1 and wherein said mechanical interlock means are provided on the driver elements of the tumblers in said adjacent pairs of aligned bores.

4. A lock mechanism as defined in claim 1 and wherein said mechanical interlock means are provided on both the driver elements and the follower elements of the tumblers in said adjacent pairs of aligned bores.

5. A lock mechanism as defined in claim 1 and wherein said interlock means on each tumbler element comprise a longitudinal series of ring-like projections extending therearound.

6. A lock mechanism as defined in claim 1 and wherein said adjacent pairs of aligned bores comprise recesses in the outer surfaces of said operating and stationary parts.

7. In an axial split-pin tumbler-type lock mechanism including a lock cylinder, a barrel assembly secured within said cylinder and having a longitudinal axis extending between front and rear ends thereof, said barrel assembly including a forwardly disposed operating part rotatable about said axis and a rearwardly disposed stationary tubular sleeve part, said operating part including a head having a rear face and an axial lock shaft of reduced diameter extending rearwardly from said rear face, said sleeve part journaling said shaft and having a front face adjoining the rear face of said head at a transverse interfacial plane, means forming cylindrically-shaped longitudinal bores in said operating part head and said sleeve part, respectively, and disposed radially outwardly of said shaft therearound, said bores in respective parts being movable into and out of alignment upon rotation of said operating part, tumblers each having elements of generally circular cross section including a forwardly disposed driver element carried in one of said head bores and a separate rearwardly disposed follower element carried in one of said sleeve part bores and the elements adjoining each other when in a pair of aligned bores, said tumblers each being reciprocally movable in the axial direction in a pair of aligned bores between positions wherein the joint between said elements thereof is disposed respectively on opposite sides of said interfacial plane, said operating part being freed for rotation when said joints coincide with said interfacial plane, and spring means yieldingly urging said tumblers in aligned bores forwardly to positions wherein said interfacial plane is bridged by said follower elements to secure the operating and sleeve parts against relative rotation, said driver elements having front ends engageable with a key which when moved rearwardly moves said tumblers in aligned bores into positions wherein said joints coincide with said interfacial plane, the improvement which comprises:

providing at least one combination of two adjacent ones of said pairs of aligned bores in longitudinal communication with each other to permit sidewise engagement of an element of a tumbler in one pair with an element of a tumbler in the remaining pair, providing mechanical interlock means around the circumference of an element of a tumbler disposed in each of said adjacent pairs of aligned bores, said interlock means on respective elements being adapted for engagement with each other to interengage the elements, whereby when one of said latter tumbler elements bridges said interfacial plane, application of picking torque to said operating part tends to move the elements laterally relative to each other to cause said interengagement thereof and thereby constrain the elements to move together as a unit in the axial direction.

8. A lock mechanism as defined in claim 7 and wherein said adjacent pairs of aligned bores comprise recesses in the outer surfaces of said operating part head and said sleeve part.

9. A lock mechanism as defined in claim 8 and wherein adjacent bores are separated by a longitudinal ridge serving to maintain the normal spacing and alignment of the tumbler elements while permitting said lateral movement of the elements when picking torque is applied.

10. A lock mechanism as defined in claim 7 and wherein said interlock means on each tumbler element comprise a longitudinal series of circumferential ring-like projections thereon.

11. A lock mechanism as defined in claim 10 and wherein the sides of said projections on each element extend outwardly at angles of about 45° to a plane perpendicular to the longitudinal axis of the element.

12. A lock mechanism as defined in claim 7 and wherein said mechanical interlock means are provided on the follower elements of the tumblers in said adjacent pairs of aligned bores.

13. A lock mechanism as defined in claim 7 and wherein said mechanical interlock means are provided on the driver elements of the tumblers in said adjacent pairs of aligned bores.

14. A lock mechanism as defined in claim 7 and wherein said mechanical interlock means are provided on both the driver elements and the follower elements of the tumblers in said adjacent pairs of aligned bores.

15. A lock mechanism as defined in claim 7 and wherein said adjacent pairs of aligned bores comprise recesses in the outer surfaces of said operating head and said sleeve part, said mechanical interlock means are provided on both the driver elements and the follower elements of the tumblers in said adjacent pairs of aligned bores, and said interlock means on each tumbler element comprise a longitudinal series of circumferential angular ring-like projections thereon.

16. A lock mechanism as defined in claim 15 and wherein the sides of said projections on each element extend outwardly at angles of about 45° to a plane perpendicular to the longitudinal axis of the element.

* * * * *